US008111222B2

(12) United States Patent
Johnson et al.

(10) Patent No.: US 8,111,222 B2
(45) Date of Patent: Feb. 7, 2012

(54) METHOD OF IMPROVING THE OUTPUT UNIFORMITY OF A DISPLAY DEVICE

(75) Inventors: Mark T. Johnson, Veldhoven (NL); Markus H. Klein, Aachen (DE)

(73) Assignee: Koninklijke Philips Electronics N.V., Eindhoven (NL)

( * ) Notice: Subject to any disclaimer, the term of this patent is extended or adjusted under 35 U.S.C. 154(b) by 1333 days.

(21) Appl. No.: 10/535,296

(22) PCT Filed: Nov. 14, 2003

(86) PCT No.: PCT/IB03/05157

§ 371 (c)(1), (2), (4) Date: May 17, 2005

(87) PCT Pub. No.: WO2004/047058

PCT Pub. Date: Jun. 3, 2004

(65) Prior Publication Data

US 2006/0071886 A1 Apr. 6, 2006

(30) Foreign Application Priority Data

Nov. 21, 2002 (EP) ..... 02102617

(51) Int. Cl.
*G09G 3/30* (2006.01)

(52) U.S. Cl. ..... 345/77; 315/155

(58) Field of Classification Search ..... 315/169.2, 315/155; 345/76, 77, 82, 207; 438/17
See application file for complete search history.

(56) References Cited

U.S. PATENT DOCUMENTS

| | | | | |
|---|---|---|---|---|
| 6,133,054 | A * | 10/2000 | Henson | 438/17 |
| 6,329,758 | B1 * | 12/2001 | Salam | 315/169.2 |
| 7,088,318 | B2 * | 8/2006 | Malmberg | 345/77 |
| 7,161,566 | B2 * | 1/2007 | Cok et al. | 345/76 |
| 7,253,813 | B2 * | 8/2007 | Yamada | 345/207 |
| 2002/0030647 | A1 * | 3/2002 | Hack et al. | 345/82 |
| 2002/0047550 | A1 * | 4/2002 | Tanada | 315/155 |

* cited by examiner

*Primary Examiner* — Quan-Zhen Wang
*Assistant Examiner* — Yuk Chow

(57) ABSTRACT

The output uniformity of a display device, such as a self light emitting display device, is improved by detecting the emitted brightness of pixels of the display device using an external detection system, controlling the pixel intensity to determine the non-uniformity of the driver circuits connected with the pixels, and generating a calibration factor for the pixels to modify the output of the driver circuits. Calibration can be performed for each pixel, or each group of pixels, such as each row and column of pixels.

20 Claims, 3 Drawing Sheets

METHOD OF IMPROVING THE OUTPUT UNIFORMITY OF A DISPLAY DEVICE

This invention relates to a method of improving the output uniformity of a display device, preferably a self light emitting display device, and most preferably an organic light emitting diode based display device. The invention also relates to a system implementing the method and to a display for use with said system.

Recently, the interest for self light emitting display devices has been increasing. For example, self light emitting display devices, which utilises self light emitting materials, such as polymer or organic light emitting materials, have been found to be a potential substitute for other display types, such as liquid crystal displays or cathode ray tubes.

Basically, a self light emitting display device, such as a polymer light emitting diode display or an organic light emitting diode display comprises a plurality of pixels, each containing self light emitting material, and a driving structure, for applying a driving current to the self light emitting material. Commonly, the device comprises a matrix of pixels arranged on a substrate, such as a glass or polymer substrate. The matrix structures may essentially be sub-divided into two main groups, passive and active matrix structures. In a passive matrix polymer or organic light emitting display, a layer of light emitting material is arranged between a row electrode layer and a column electrode layer being intersecting (see FIG. 1) and thus forming pixels. Typically, the display emission is controlled by means of data drivers, each controlling the current through a column. In an active matrix polymer or organic light emitting display (see FIG. 2), each pixel of a pixel matrix is controlled by means of pixel driving circuit. Moreover, each column is controlled by means of a data driving circuit.

However, a problem with active matrix polymer light emitting diode displays, using p-Si thin film transistors is that variations of the characteristics of such transistors result in a random pixel-to-pixel variation of the brightness of the display, resulting in non-uniformity of the display output. This variation is particularly strong for the most simple transconductance circuits, having two thin film transistors per pixel, in which a drive thin film transistor is used to convert an addressing voltage to a driving current. Examples of such circuits are shown in FIG. 3 and FIG. 4. Therefore, this type of circuit is unsuitable for high-performance displays. However, for other reasons, the most simple trans-conductance circuits are preferred, since they provide a high pixel aperture, may be addressed very quickly, even at low brightness levels and are also the most simple to address, since they essentially may use established drivers, similar to the ones used in liquid crystal displays. To overcome the above problems would therefore be advantageous.

An additional problem is that current generating data drivers for AMP(O)LED devices are not readily available at this point. One reason for this is again the requirement of high uniformity; if any one of the driver outputs has a different current value, this will be instantly recognisable as a bright or dark line running through the display. For this reason, uniformity of the driver is even more essential than uniformity of the pixels themselves, where the randomness of the uniformity variations renders the visibility somewhat lower. One way to solve this problem that has been proposed is to use drivers of a self compensating current mirror type. However, this solution is complex and requires much space, and moreover, such drivers are slow to address and are less accurate at lower current levels, and they also require higher driving voltages, hence consumes more power. As an alternative, simpler and less complicated drivers, such as a 2 TFT transconductance driver, may be used, but as indicated above, they have an unacceptable non-uniformity.

Moreover, also in the case of a passively driven self light emitting display device, non-uniformity of the data driver output is a problem, in much the same way as described above.

Hence, a general method for improving or overcoming non-uniformity issues in display devices in general and in display devices in particular is desired, and an object of this invention is consequently to achieve such a method, overcoming the disadvantages with the prior art, as indicated above.

This and other objects is at least in part achieved by a method according to claim 1. According to this method, the output uniformity of a display device is improved by; detecting a first emitted brightness of at least one pixel of display device; by means of the detected first brightness, determining the non-uniformity of an output of a driver circuit being connected with said pixel; and, based on said first detected brightness, generating a calibration factor for the at least one pixel, to be used to modify the output of the driver circuit, in order to improve the uniformity. In this manner, non-uniformity in the display emission, resulting from variations in a single device characteristics which scales linearly with the light output, may be compensated for. By measuring the pixel output at different brightnesses, it is possible to distinguish uniformity variations from different sources. Preferably, the method may be used for self light emitting display devices, and more preferably for organic light emitting diode based display devices.

More generally, several factors will contribute to the non-uniformity of the display light output, including variations in the performance of transistors and other electrical components in the driving circuit, and also variations in the efficiencies of the light emitting devices themselves. Therefore, according to a preferred embodiment of the invention, the method further comprises the step of, after detecting said first emitted brightness, adjusting an average display brightness, and thereafter detecting a second emitted brightness of said at least one pixel, and based on said first and second detected brightnesses, generating a calibration factor for the at least one pixel, to be used to modify the output of the driver circuit, in order to improve uniformity. In this manner, non-uniformity in the display emission resulting from variations from more than one device characteristics may be compensated for. By measuring the pixel output at different brightnesses, it is possible to distinguish uniformity variations from even more different sources.

The step of detecting the emitted brightness of at least one pixel is suitably performed by means of an external imaging system. An example of such an external system is a CCD camera based system. Hence, a fabricated display is positioned under such an external imaging system, where after the display is calibrated by using the inventive method in order to improve the output uniformity of the display. Preferably, said driver circuit is one of a pixel driver circuit or a data driver circuit, depending on the display construction.

According to a first preferred embodiment of the invention, said display device is a active matrix polymer or organic light emitting diode display device. In this case, the brightness may either be detected individually for each pixel, or simultaneously for an entire row or column of pixels, as will be further described below. However, according to one embodiment of the invention, the step of detecting the emitted brightness of at least one pixel comprises the step of individually detecting the emitted brightness for each of a plurality of pixels, being a straight-forward application of the invention on pixel level. Alternatively, the step of detecting the emitted brightness of at least one pixel comprises the step of jointly measuring the emitted brightness of a group of pixels, such as a column or a row of pixels, being commonly controlled by a common driving device. This embodiment has a number of advantages over the pixel level embodiment described above. First, column level compensation removes a more visible artefact, as is indicated above. Moreover, as stated above, less memory is required (about 100-1000 times less, representing the number of rows on a typical display and also smaller look-up tables is required, in embodiments using such tables. Further, this embodiment enables the use of more simple current driver circuits, since the uniformity demands on such circuits may be lowered. Thereby, faster components, having a lower power consumption and/or a smaller size may be used. Furthermore, this embodiment may be used for all brightness levels, as generating low output current values no longer requires low programming currents, which makes programming slow, but now may be implemented by programming only voltages, which is faster. In addition, this embodiment is also faster to implement, since less data is to be loaded into look-up tables and so on.

In order to further improve the output uniformity of an active matrix display device, the method may further comprise the step of aligning, in one of a column or a row of pixels, all transistors of all pixels in a direction, being the direction of a laser beam during a laser recrystallisation step during the fabrication of said transistors.

According to another preferred embodiment of this invention, said display device is a passive matrix polymer or organic light emitting diode display device. In the same way as above, for the active matrix embodiment, the step of detecting the emitted brightness of at least one pixel suitably comprises the step of jointly measuring the emitted brightness of a group of pixels, such as a column or a row of pixels, being commonly controlled by a common driving device.

Also, said calibration factors are preferably memorised in the driver circuit for the pixel, column or row, or in the display controller, by one of the methods; storing the calibration factors in a memory device, burning fuses on one of a transistor substrate or an additional driver integrated circuit, or laser trimming of one of a transistor substrate or an additional driver integrated circuit.

The above and other objects of the invention are also at least partly achieved by a system for calibrating a display device, for improving the output uniformity of the same, comprising a unit for holding a display device to be calibrated, an imaging system, being positioned so as to, when in use, detecting emitted brightness from the entire display device surface of the display device, and a feedback system, for transmitting information regarding the emitted brightness back to the display device, the system being arranged to perform the inventive method described above. Preferably, the display device to used with the system is a self light emitting display device, preferably an organic light emitting diode based display device.

Also, the above and other objects of the invention are also at least partly achieved for use with a system as defined above. According to a preferred embodiment, the display device further comprises a plurality of light emitting pixels being arranged in a row and column structure, wherein either each column or each row of pixels being connected with a data driver circuit, wherein each column or each row comprises an additional non-light emitting pixel, incorporating a current measurement device, for monitoring a relative change over time of an output signal from said data driver.

The invention will hereinafter be described in closer detail, by means of preferred embodiments thereof, with reference to the accompanying drawings.

Figure 5:
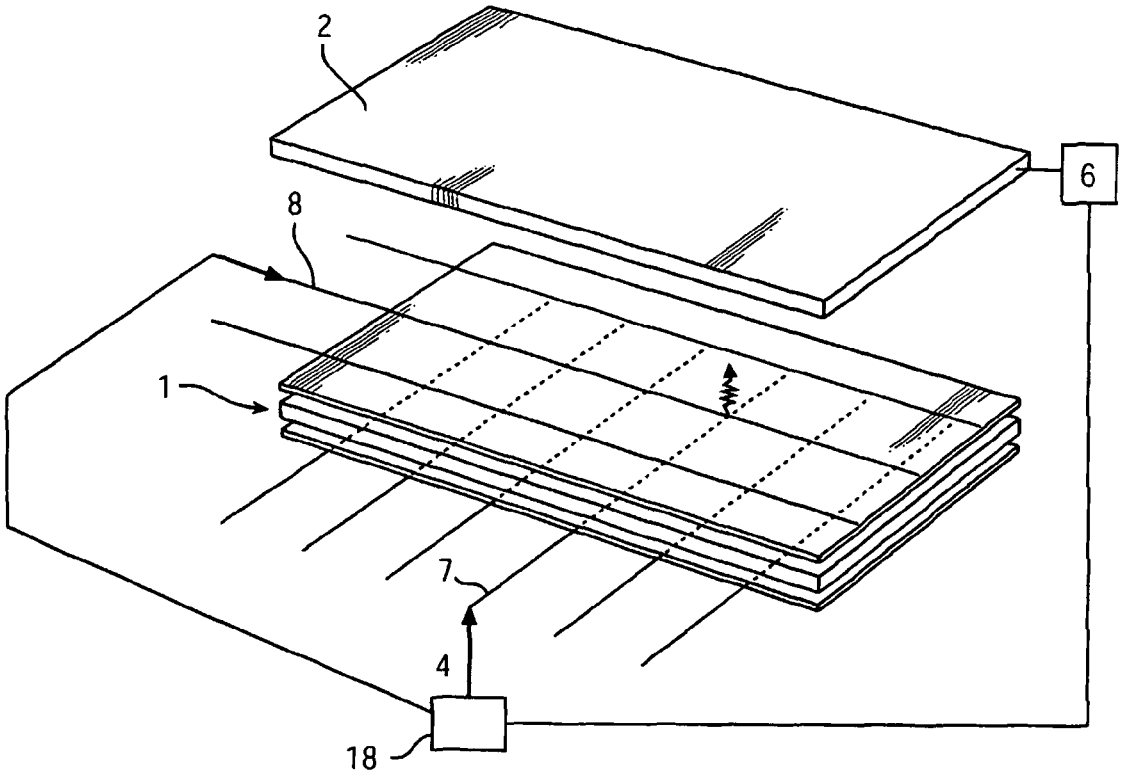

FIG. 5 schematically discloses a basic explanatory system embodying the present invention.

Figure 1:
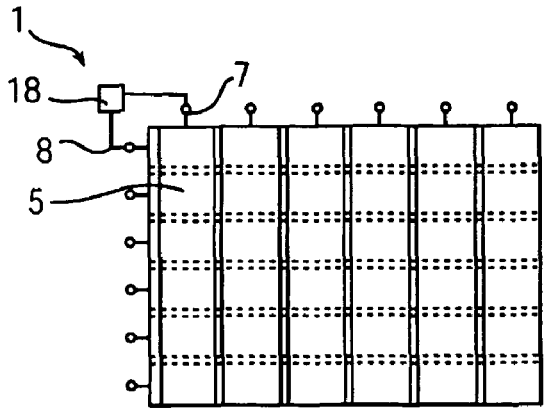
FIG. 1 is a schematic drawing of the basic configuration of a passive matrix polymer or organic light emitting diode display, essentially comprising a matrix of intersecting row and column electrodes, whereby a layer of polymer or organic light emitting material is sandwiched between a layer of row electrodes and a layer of column electrodes.

FIG. 1 schematically discloses a passive matrix polymer or organic light emitting display device for which the present invention may be used. In the disclosed passive matrix polymer or organic light emitting display, a layer of light emitting material is arranged between a row electrode layer 8 and a column electrode layer 7 being intersecting (see FIG. 1) and thus forming pixels 5.

Figure 2:
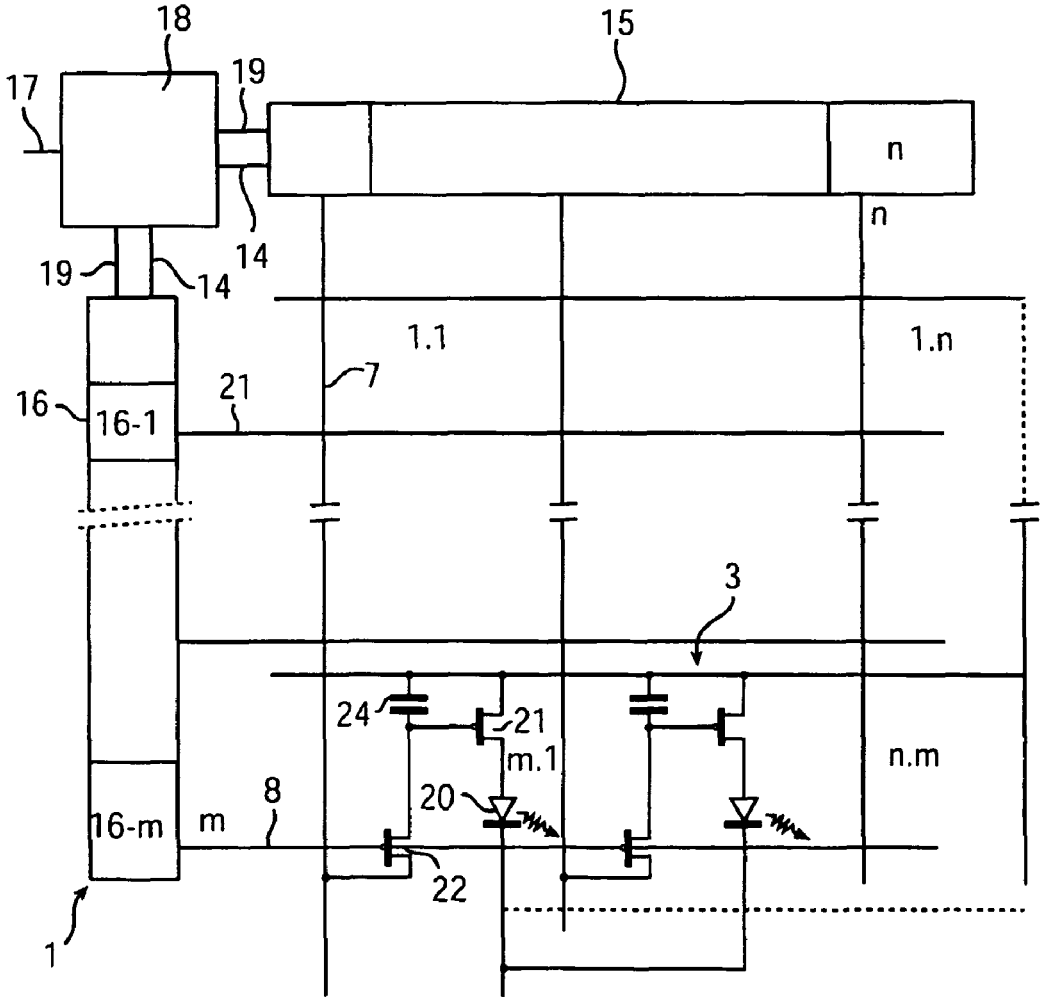
FIG. 2 is a schematic drawing of the basic configuration of an active matrix polymer or organic light emitting diode display.

FIG. 2 schematically discloses an equivalent circuit diagram of a part of an active matrix polymer or organic light emitting display device 1, for which the present invention may be used. This display device comprises a matrix of (P) LEDs or (O)LEDs with m rows (1, 2, . . . , m) and n columns (1, 2, . . . , n). Where rows and columns are mentioned, it shall be noted that they may be interchanged, if desired. The device further comprises a row selection circuit 16, connected with said rows and a data register 15 connected with said columns. Externally presented information 17, for example, a video signal, is processed in a processing unit 18 which, dependent on the information to be displayed, charges separate parts 15-1, . . . **15-*n* of the data register 15 via supply lines 19. The selection of row takes place by means of the row selection circuit 16, via the row lines 8, in this case gate electrodes of transistors 22, such as TFT transistors, by providing them with the required selection voltage. Writing data takes place in that, during selection, data signals are provided from the data register 15, in this case in the form of voltage signals. During addressing, a capacitor 24 is charged to the level of the data voltage via the transistors. This capacitor determines the adjustment of the transistor 21 and hence the actual current through the LED 20 during a driving period and the luminance of the pixel. Synchronisation between the selection of rows 8 and the presentation of voltages to the columns 7 takes place by means of the processing unit 18, via drive lines 14**.

The basic idea behind the invention will hereinafter be described, followed by a number of preferred embodiments thereof. A basic explanatory system embodying the present invention is disclosed in FIG. 5, for illustrative purposes only. Here, a fabricated self light emitting display 1 is arranged to be adjusted in order to improve the output uniformity of the light-emitting elements of the display. The display device may for example be a passive matrix polymer or organic light emitting display, as described above and as schematically shown in FIG. 1, or an active matrix polymer or organic light emitting display (AMP(O)LED) as described above and as schematically shown in FIG. 2.

Figure 3:
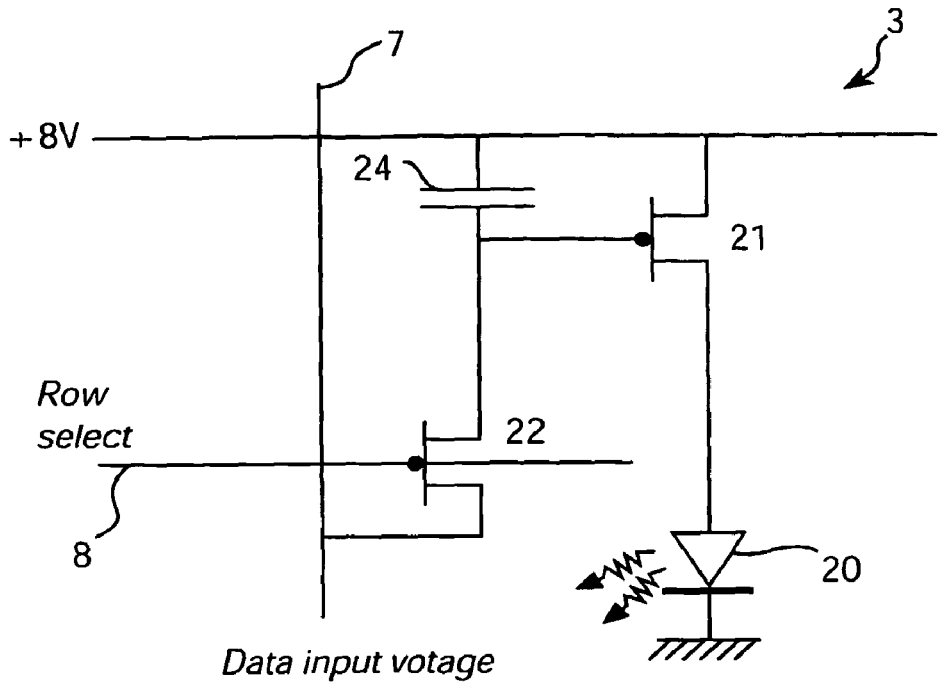
FIG. 3 is a schematic drawing of a first current source circuit, that may be used in the display disclosed in FIG. 2.
Figure 4:
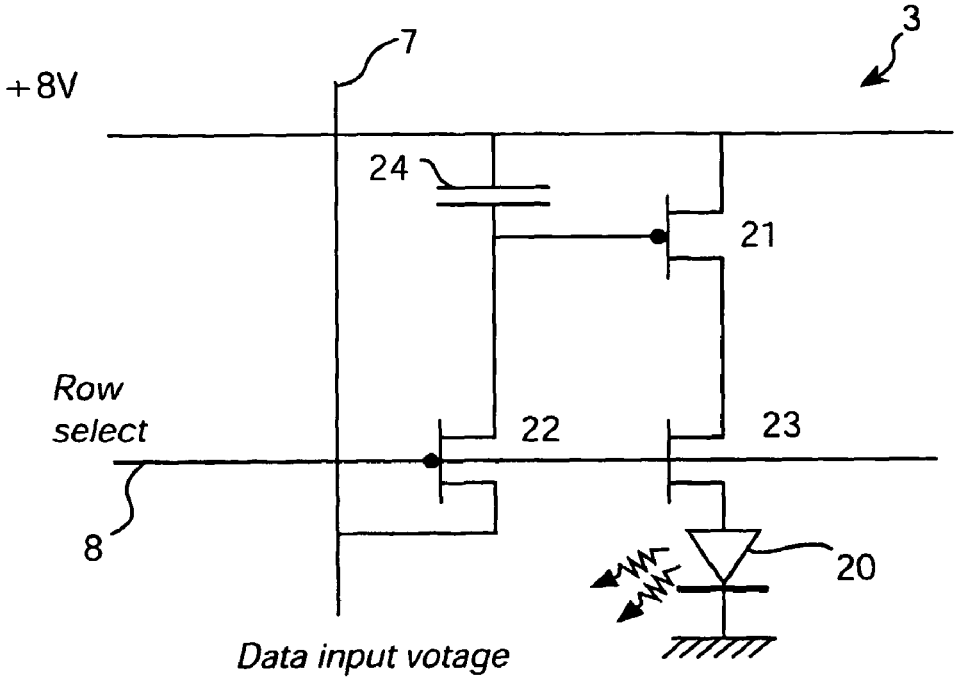
FIG. 4 is a schematic drawing of a second current source circuit, that may be used in the display disclosed in FIG. 2.

The fabricated display device 1 is positioned under an external imaging system 2. This system may for example be a CCD camera-based system, able to detect light emitted from the display device 1. Thereafter the display device 1 is addressed in order to emit light. The addressing may be done one pixel at a time, one column at a time or one row at the time, as will be further described below. The addressing is made by means of a driver circuit 3. The driver circuit may be a pixel driver circuit, as disclosed in FIG. 5, (active matrix configuration only), in which one driver circuit is arranged for each pixel of the display device 3. Examples of such circuits are disclosed in FIG. 3 and FIG. 4. Alternatively, the driver circuit is a data driver circuit, (applicable for both passive and active matrix configuration), in which one driver circuit 3 is arranged for each pixel column of the display, to control the column of pixels. In any case, all driver circuits of the display are connected with a central processing unit/a controller unit of the display (not shown) being used to provide information to each driver circuit about what driver circuits is to be addressed at a certain time.

However, in the example disclosed in FIG. 5, one pixel of the display 1 is addressed at a time, whereby the pixel emits light, having a brightness depending on an output signal 4 to the driving circuit 3. The emitted brightness from the pixel is thereafter detected by the external imaging system 2, where after the detected brightness is fed back to the driver circuit 3 (or, alternatively, to a separate processing unit, connected to the driver circuit), via a feedback unit 6. In the driver circuit 3 (or the separate processing unit), the detected brightness is compared with a desired brightness for the output signal 4 in question, and the display non-uniformity of that specific output signal 4 may be established by signal processing. Thereafter, if required, the output signal 4, and hence the emitted brightness is adjusted, and the above detection is repeated, one or more times. From the values obtained by those measurements, the non-uniformity of essentially each possible value of the output signal may be established by means of interpolation, and from these values, a calibration factor, adjusting each output signal for achieving a desired pixel output is calculated. This calibration factor is thereafter stored in the driver circuit or in an associated circuit. This may be made by storing the calibration factor in a memory or by adjusting the hardware, for example by burning fuses or use laser trimming on the driver circuit or an associated circuit.

In order to achieve calibration factors for all pixels of the display, the above process is repeated for all pixels of the display, and in the case of a full-colour display, for each colour of the display. Alternatively, an entire display, i.e. all pixels of the display, may be addressed simultaneously with a calibration image, and in this case, the output of all pixels are measured simultaneously by the imaging system 2.

The above method may equally well be used on a column/row level. However in this case, an entire column or row is addressed at once, and the integral brightness of all pixels along the column/row is detected. The calibration factors are in this case implemented in a data driver circuit, instead of in the pixel driver circuit. Also in this case, an entire display, i.e. all pixels of the display, may be addressed simultaneously with a calibration image, and in this case, the output of all columns/rows are measured simultaneously by the imaging system 2.

EMBODIMENT 1

According to a first embodiment of this invention, the inventive method is implemented at pixel level in a AMP(O) LED display. A fabricated AMP(O)LED display is placed under an imaging system, such as a CCD camera based system. The display is turned on so that the pixel that is to be studied emits light (the process is repeated for all pixels of the display that is to be studied. Alternatively, all pixels could be addressed at once, as described above). The brightness of the pixel is determined, and the determined brightness is thereafter compared with a desired brightness for the given driving input to the pixel. By this comparison, a measure for the non-uniformity of the pixel circuit output is determined. Examples of situations where a correction based on this non-uniformity measure is sufficient are for pixel driving circuits where only variations in the mobility of individual transistors define the non-uniformity, or where the variation in the efficiency of the light emitting device itself is responsible for the non-uniformity of the display brightness. The above process is repeated for all pixels, and also for all colours in a full colour display.

Subsequently, the measure of the non-uniformity of the pixel output is used to calculate a calibration factor, which is stored in a full frame memory in the display device, the memory being connected to the drive circuit of the pixel. If desired, a look-up table may be generated from the derived factors in order to derive calibration factors for different brightness levels. The calibration factors stored in the memory, or the factors derived from the look-up table or an analytical function, as the case may be, is hereafter used to modify the input to the pixel driver in order to maintain uniformity in all pixels at all brightness levels. Signal processing approaches for such modifications are known in the prior art.

EMBODIMENT 2

According to a second embodiment of this invention, the inventive method is implemented at pixel level in a AMP(O) LED display. A fabricated AMP(O)LED display is placed under an imaging system, such as a CCD camera based system. The display is turned on so that the pixel that is to be studied emits light (the process is repeated for all pixels of the display that is to be studied. Alternatively, all pixels could be addressed at once, as described above.) The brightness of the pixel is determined, and the determined brightness is thereafter compared with a desired brightness for the given driving input to the pixel. By this comparison, a measure for the non-uniformity of the pixel circuit output is determined. The above process is repeated for all pixels, and also for all colours in a full colour display.

Thereafter, the average display brightness is adjusted, where after the above process is repeated, and hence the pixel brightness is remeasured. The process may be repeated several times, if desired, each time measuring at a different brightness level.

When measuring the pixel output at different brightnesses it is possible to distinguish uniformity variations from different sources. For example, for a transconductance pixel circuit, both TFT mobility ($\mu$) and TFT threshold voltage ($V_{th}$) variations contribute to the brightness of the pixel in different manners following the following relationship:

$$I \propto \mu \cdot (V - V_{th})^2 \quad (1)$$

In addition, non-uniformity resulting from variations in the technology, or degradation of emitting devices may be eliminated by extension of this method to further brightnesses.

Subsequently, the measure of the non-uniformity of the pixel output is used to calculate a calibration factor, which is stored in a full frame memory in the display device, the memory being connected to the drive circuit of the pixel. Alternatively, the values of $\mu$, $V_{th}$, etc. may be stored in the memory. If desired, a look-up table may be generated from the derived factors in order to derive calibration factors for different brightness levels. The calibration factors stored in the memory, or the factors derived from the stored parameters, a look-up table or an analytical function, as the case may be, is hereafter used to modify the input to the pixel driver in order to maintain uniformity in all pixels at all brightness levels. Signal processing approaches for such modifications are known in the prior art.

EMBODIMENT 3

This embodiment is similar to the one described under embodiments 1 and 2, but in embodiment 3 the calibration factors are not stored in an additional memory. Instead the calibration factors are introduced to the pixel driver by means of burning fuses or laser trimming of components. This may be done on the p-Si substrate, but may alternatively be made on an additional driver circuit, or circuits, being connected to the pixel driver. The advantage of this embodiment is that it may be implemented at a comparatively low cost.

EMBODIMENT 4

According to a fourth embodiment of this invention, the inventive method is implemented at data driver level in a AMP(O)LED display.

A fabricated AMP(O)LED display is placed under an imaging system, such as a CCD camera based system. The display is turned on so that the pixel column that is to be studied emits light (the process is repeated for all columns of the display that is to be studied. Alternatively, all columns may be addressed at once, as described above.) The brightness of the entire pixel column is determined, and the determined brightness is thereafter compared with a desired brightness for the given driving input to the column. By this comparison, a measure for the non-uniformity of the data driver circuit output, resulting from a variation in a single device characteristic which scales linearly with the light output, is determined. Examples of situations where such a correction will be sufficient are for data driving circuits where only variations in the mobility of individual transistors define the non-uniformity. The above process is repeated for all columns, and also for all colours in a full colour display. By studying an entire column at once, the effect of random brightness variation of individual pixels is minimised.

Subsequently, the measure of the non-uniformity of the pixel column output is used to calculate a calibration factor, which is stored in a comparatively small memory (since only one calibration factor is needed per column, instead as per pixel as in embodiment 1) in the display device, the memory being connected to the drive circuit of the pixel column. Alternatively, the values of $\mu$, $V_{th}$, etc. may be stored in the memory. If desired, a comparatively small look-up table, as compared to embodiment 1, may be generated from the derived factors in order to derive calibration factors for different brightness levels. The calibration factors stored in the memory, or the factors derived from the stored parameters, a look-up table or an analytical function, as the case may be, are hereafter used to modify the input to the data driver in order to maintain uniformity in all columns at all brightness levels. Signal processing approaches for such modifications are known in the prior art.

As compared to the pixel level compensation, described under embodiment 1, the column level compensation described under embodiment 4 has a plurality of advantages. First, column level compensation removes a more visible artefact, as is indicated above. Moreover, as stated above, less memory is required (about 100-1000 times less) and also smaller look-up tables are required, in embodiments using such tables. Further, this embodiment enables the use of more simple current driver circuits, since the uniformity demands on such circuits may be lowered. Thereby, faster components, having a lower power consumption and/or a smaller size may be used. Furthermore, as explained above, this embodiment may be used for all brightness levels, and it is also faster to implement, since less data is to be loaded into look-up tables and so on.

EMBODIMENT 5

According to a fifth embodiment of this invention, the inventive method is implemented at data driver level in a AMP(O)LED display.

A fabricated AMP(O)LED display is placed under an imaging system, such as a CCD camera based system. The display is turned on so that the pixel column that is to be studied emits light (the process is repeated for all columns of the display that is to be studied. Alternatively, all columns may be studied at once, as explained above. The brightness of the entire pixel column is determined, and the determined brightness is thereafter compared with a desired brightness for the given driving input to the column. By this comparison, a measure for the non-uniformity of the pixel circuit output is determined. The above process is repeated for all pixels, and also for all colours in a full colour display. By studying an entire column at once, the effect of random brightness variation of individual pixels is minimised.

Thereafter, the average display brightness is adjusted, where after the above process is repeated, and hence the pixel column brightness is remeasured. The process may be repeated several times, if desired, each time measuring at a different brightness level.

Measuring the pixel column output at different brightnesses enables distinction of uniformity variations from different sources. For example, for a transconductance column driver, both TFT mobility ($\mu$) and TFT threshold voltage ($V_{th}$) variations contribute to the brightness of the pixel in different manners following the same relationship as defined by equation (1).

Subsequently, the measure of the non-uniformity of the pixel column output is used to calculate a calibration factor, which is stored in a comparatively small memory (as compared to embodiment 1) in the display device, the memory being connected to the drive circuit of the pixel column. Alternatively, the values of $\mu$, $V_{th}$, etc. may be stored in the memory. If desired, a small look-up table may be generated from the derived factors in order to derive calibration factors for different brightness levels. The calibration factors stored in the memory, or the factors derived from the stored parameters, a look-up table or an analytical function, as the case may be, is hereafter used to modify the input to the data driver in order to maintain uniformity in all columns at all brightness levels. Signal processing approaches for such modifications are known in the prior art.

As compared to the pixel level compensation, described under embodiment 1, the column level compensation described under embodiment 3 has a plurality of advantages. First, column level compensation removes a more visible artefact, as is indicated above. Moreover, as stated above, less memory is required (about 100-1000 times less) and also smaller look-up tables is required, in embodiments using such tables. Further, this embodiment enables the use of more simple current driver circuits, since the uniformity demands on such circuits may be lowered. Thereby, faster components, having a lower power consumption and/or a smaller size may be used. Furthermore, this embodiment may be used for all brightness levels, as explained above, and it is also faster to implement, since less data is to be loaded into look-up tables and so on.

EMBODIMENT 6

According to a sixth embodiment of this invention, the inventive method is implemented in a further improved way at data driver level in a AMP(O)LED display.

While embodiments 4 and 5 described above provides a lower cost implementation, it does not removed pixel-to-pixel variations caused by variations in the TFT performance. Examples of driving circuits comprising TFTs are disclosed in FIG. 3 and FIG. 4. When manufacturing a TFT, details of the laser crystallisation step during the p-Si fabrication process results in a difference in performance of the component, either along a laser scan direction or in the direction of a laser beam. In general, uniformity is higher along the laser beam and worse in its scan direction. Hence, according to the fourth embodiment of this invention, all drive TFTs for all pixels along a column of the display is aligned in the direction of the laser beam. Thereby, the uniformity of the TFTs within the column will be as high as possible, whilst the variation between different columns will be large. The latter is however less important, as column-to-column variations may be corrected using the approach described under embodiment 3. In this way, a display having an improved pixel-to-pixel uniformity may be achieved, without increasing the cost as compared to the method described under embodiment 3.

EMBODIMENT 7

According to a seventh embodiment of this invention, the inventive method is implemented in an additional further improved way at data driver level in a AMP(O)LED display.

In an alternative to embodiment 3 and in the same spirit as in embodiment 4, all drive TFTs of a row in a display device may be aligned in the direction of the laser beam during manufacture of the TFTs. In this case, the uniformity of the TFTs within a row will be as high as possible, whilst the row-to-row variation will be large. In order to solve this problem, it is in addition necessary to determine a brightness calibration factor for each row of the display. This may be done in the corresponding way as defined under embodiment 3, but instead investigating the integral brightness for each row. Thereafter, both the column calibration factor, as obtained in accordance with embodiment 3, and the above-described row calibration factor are stored in the corresponding way as in previous embodiments. In this case, column data will be processed using the stored information of both the average row and column calibration factors, based on the stored row and column calibration factors. By this embodiment, a display with an improved pixel-to-pixel uniformity may be achieved, having only a slight increase of cost as compared to the approach suggested under embodiment 3.

EMBODIMENT 8

According to a eight embodiment of this invention, the inventive method is implemented in yet a further improved way at data driver level in a AMP(O)LED display.

In the embodiments 3-5 described above, column (and row) calibration factors are stored in an additional small memory. However, according to this embodiment, calibration may also be made by burning fuses or laser trimming of components, in the same way as is described under embodiment 2 for the pixel level implementation. This may be done on the p-Si substrate, but may alternatively be made on an additional driver circuit, or circuits, being connected to the data driver. The advantage of this embodiment is that it may be implemented at a comparatively low cost.

EMBODIMENT 9

All of the above embodiments address the problem of display uniformity at the start of the display lifetime, i.e. during manufacture or shortly thereafter. However, degradation of the p-Si TFTs during usage may introduce non-uniformities as the display is used. In order to avoid this problem, a current measurement device may be added to each data driver. Preferably, this may be achieved by adding a dummy pixel to each column, incorporating the current measurement device. The function of this current measurement device is to monitor any changes in the output of the column during the lifetime of the display. It shall be noted that it is only necessary to monitor a relative change of the output, i.e. the difference between the current output and the initially measured output, as defined by the brightness measurements performed at the start of the display lifetime, in accordance with any one of the above-described embodiments. The monitoring of the relative change should be performed occasionally, rather than constantly, in order to avoid distortion of the display operation and avoid causing degradation within the TFTs of the measuring circuit itself. Any monitored change in the output triggers an update of the calibration factor for the appropriate data driver, for example by calculating and storing the new calibration value in the appropriate memory spot.

EMBODIMENT 10

While the above embodiments are primarily focused on applying the present invention on a AMP(O)LED display, this embodiment describes the inventive method as implemented at data driver level for a passive polymer or organic light emitting diode display (P(O)LED).

According to this embodiment, a fabricated passive P(O) LED display, including final driver integrated circuits is placed under an imaging system, such as a CCD camera based system. The display is turned on so that the pixel column that is to be studied emits light (the process is repeated for all columns of the display that is to be studied. Alternatively, all columns may be studied at once, as described above.) The integral brightness along the complete column is determined, and the determined brightness is thereafter compared with a desired brightness for the given driving input to the column. By this comparison, a measure for the non-uniformity of the driver IC output is determined. The above process is repeated for all columns, and also for all colours in a full colour display. By studying an entire column at once, the effect of random brightness variation of individual pixels is minimised.

Thereafter, the average display brightness is adjusted, where after the above process is repeated, and hence the column brightness is remeasured. The process may be repeated several times, if desired, each time measuring at a different brightness level.

Subsequently, the measure of the non-uniformity of the column output is used to calculate a calibration factor, which is stored in a small memory in the display device, the memory being connected to the drive circuit of the pixel column. Alternatively, the values of $\mu$, $V_{th}$, etc. may be stored in the memory. If desired, a small look-up table may be generated from the derived factors in order to derive calibration factors for different brightness levels. Alternatively, the calibration factors may be "stored" in the device by burning fuses or use laser trimming on the driver IC, in the corresponding way as described in the embodiments 2 and 6.

The calibration factors stored in the memory, or the factors derived from the stored parameters, a look-up table or an analytical function, as the case may be, is hereafter used to modify the input to the data driver in order to maintain uniformity in all columns at all brightness levels. Signal processing approaches for such modifications are known in the prior art.

While this invention has been described in conjunction with specific embodiments thereof, it is evident that many alternatives, modifications and variations will be apparent to those skilled in the art. In particular, whilst several embodiments have been described in terms of polymer or organic LED based self light emitting displays, the invention is equally applicable to other types of self light emitting display devices, such as field emission displays, plasma displays etc. and also to non-light emitting displays, for example light valve type displays such as liquid crystal displays. Accordingly, the preferred embodiments of the invention, as set fourth herein, are intended to be illustrative, not limiting. Various changes may be made without departing from the spirit and scope of the invention as defined in the following claims.

The invention claimed is:

1. A method of improving the output uniformity of a display device comprising the acts of:

charging a capacitor to a first level for operating at least one pixel to emit a first emitted brightness;

detecting the first emitted brightness of the at least one pixel of the display device via an external detection system that is substantially independent of the display device;

determining non-uniformity of an output of a driver circuit connected with the at least one pixel based on the first emitted brightness;

generating a calibration factor for the at least one pixel based on the non-uniformity to be used to modify the output of the driver circuit to improve the output uniformity when the at least one pixel is emitting the first emitted brightness;

charging the capacitor to a second level for operating the at least one pixel to emit a further emitted brightness which is different from the first emitted brightness; and repeating the acts of detecting, determining and generating for generating a further calibration factor for modifying the output of the driver circuit when the at least one pixel is emitting the further emitted brightness so that the output of the driver circuit is compensated by varying the charge on the capacitor.

2. The method according to claim 1, wherein said display device is a self light emitting display device.

3. The method according to claim 1 or 2, wherein said display device is an organic light emitting diode based display device.

4. The method according of claim 1, including:

adjusting an average display brightness, detecting a second emitted brightness of the at least one pixel and generating the calibration factor based on the first and second detected brightness.

5. The method of claim 1, wherein the external detection system includes an external imaging system.

6. The method of claim 1, wherein said driver circuit is one of a pixel driver circuit or a data driver circuit.

7. The method of claim 1, wherein the display device is an active matrix polymer or organic light emitting diode display device.

8. The method of claim 7, wherein detecting the emitted brightness of at least one pixel includes individually detecting the emitted brightness for each of a plurality of pixels.

9. The method of claim 7, including aligning, in one of a column or a row of pixels, all transistors of all pixels in a direction of a laser beam during laser recrystallisation during fabrication of the transistors.

10. The method of claim 1, wherein the display device is a passive matrix polymer or organic light emitting diode display device.

11. The method of claim 1, wherein detecting the emitted brightness of at least one pixel includes jointly measuring an emitted brightness of a group of pixels commonly controlled by a common driving device.

12. The method of claim 1, including storing the calibration factors in a memory device associated with the driver circuit.

13. The method of claim 1, including burning fuses on a circuit associated with the driver circuit.

14. A system comprising:

a unit for holding a display device to be calibrated;

a detection system that is substantially independent of the display device and configured to detect emitted brightness from the entire display device surface of the display device;

a feedback system that is configured to communicate information based on the emitted brightness to the display device to facilitate improvement of output brightness uniformity by adjustment of one or more drivers of the display device; and a processor configured to:

charge a capacitor to a first level for operating at least one pixel to emit a first emitted brightness;

determine non-uniformity of an output of a driver circuit connected with the at least one pixel based on the first emitted brightness detected by the external detector;

generate a calibration factor for the at least one pixel based on the non-uniformity to be used to modify the output of the driver circuit to improve the output uniformity when the at least one pixel is emitting the first emitted brightness;

charge the capacitor to a second level for operating the at least one pixel to emit a further emitted brightness which is different from the first emitted brightness; and repeat the determining and generating for generating a further calibration factor for modifying the output of the driver circuit when the at least one pixel is emitting the further emitted brightness so that the output of the driver circuit is compensated by varying the charge on the capacitor.

15. A system according to claim 14, wherein the display device is a self light.

16. A display device comprising a processor configured to receive information based on an emitted brightness of one or more pixels of the display device from and external detector that is independent of the display device, and includes at least one component of at least one driver that is adjusted based on the information to improve an output brightness uniformity of the display device, the processor being further configured to:

charge a capacitor to a first level for operating at least one pixel to emit a first emitted brightness;

determine non-uniformity of an output of the at least one driver connected with the at least one pixel based on the first emitted brightness detected by the external detector;

generate a calibration factor for the at least one pixel based on the non-uniformity to be used to modify the output of the at least one driver to improve the output uniformity when the at least one pixel is emitting the first emitted brightness;

charge the capacitor to a second level for operating the at least one pixel to emit a further emitted brightness which is different from the first emitted brightness; and repeat the determining and generating for generating a further calibration factor for modifying the output of the at least one driver when the at least one pixel is emitting the further emitted brightness so that the output of the at least one driver is compensated by varying the charge on the capacitor.

17. A display device as defined in claim 16, wherein the display device comprises a plurality of light emitting pixels being arranged in a row and column structure, wherein either each column or each row of pixels is connected with a data driver circuit, wherein each column or row includes a current measurement device, and a controller that is configured to adjust an output of the data drive circuit based on a relative change over time current detected by the current measurement device.

18. The display device of claim 16, wherein the at least one component includes one or more fuses.

19. The display device of claim 16, wherein the at least one component includes one or more fuses.

20. The display device of claim 16, wherein the at least one component includes one or more transistors that are laser trimmed based on the information.

* * * * *